United States Patent [19]

Kasamura et al.

[11] Patent Number: 4,740,808

[45] **Date of Patent: * Apr. 26, 1988**

[54] DEVELOPER CONTAINER AND A DEVELOPING APPARATUS USABLE WITH THE SAME

[75] Inventors: Toshirou Kasamura, Yokohama; Nobukazu Sasaki, Tokyo, both of Japan

[73] Assignee: Canon Kabushiki Kaisha, Tokyo, Japan

[ * ] Notice: The portion of the term of this patent subsequent to Sep. 16, 2003 has been disclaimed.

[21] Appl. No.: 567,501

[22] Filed: Jan. 3, 1984

[30] Foreign Application Priority Data

| | | | |
|---|---|---|---|
| Jan. 8, 1983 | [JP] | Japan | 58-1563 |
| Jan. 8, 1983 | [JP] | Japan | 58-1564 |
| Jan. 8, 1983 | [JP] | Japan | 58-1566 |
| Jan. 8, 1983 | [JP] | Japan | 58-1567 |
| Jan. 8, 1983 | [JP] | Japan | 58-1569 |

[51] Int. Cl.[4] ..... G03G 15/08

[52] U.S. Cl. ..... 355/3 DD; 355/4

[58] Field of Search ..... 355/3 DD, 3 R, 4; 222/DIG. 1, 365; 361/354; 307/147

[56] References Cited

U.S. PATENT DOCUMENTS

| | | | |
|---|---|---|---|
| 3,146,379 | 8/1964 | Giger, Jr. | 361/354 |
| 4,089,601 | 5/1978 | Navone | 355/3 DD |
| 4,095,879 | 6/1978 | Katayama et al. | 355/4 |
| 4,281,918 | 8/1981 | Fortmann | 355/3 R |

FOREIGN PATENT DOCUMENTS

| | | | |
|---|---|---|---|
| 2059189 | 12/1970 | Fed. Rep. of Germany | 355/4 |
| 2734631 | 2/1979 | Fed. Rep. of Germany | 355/4 |
| 0021166 | 2/1981 | Japan | 355/3 DD |

*Primary Examiner*—A. C. Prescott
*Assistant Examiner*—David Warren
*Attorney, Agent, or Firm*—Fitzpatrick, Cella, Harper & Scinto

[57] ABSTRACT

A developing apparatus loadable with a developer container. The container having a developer of the desired color is selectively inserted into a developing apparatus and then rotated therein in a predetermined direction so that the developer container will be set in place within the developing apparatus. The developer container is detachable relative to the developing apparatus and includes a protrusion for positioning the developer container within the developing apparatus and another protrusion for discriminating the color of the developer in the selected container. The positioning protrusion is located upstream of the color discriminating protrusion in the above predetermined direction of rotation. The developing apparatus includes a developer receptacle including guide grooves for respectively guiding the positioning and discriminating protrusions of the developer container into the developer receptacle and a stopper surface which is engaged by the positioning protrusion of the developer container to limit the rotation thereof when the container is rotated within the developing apparatus in the predetermined direction.

17 Claims, 12 Drawing Sheets

DEVELOPER CONTAINER AND A DEVELOPING APPARATUS USABLE WITH THE SAME

BACKGROUND OF THE INVENTION

1. Field of the Invention

The present invention relates to a developing apparatus in which a selected developer container of the desired color is detachably mounted and to such a detachable developer container.

2. Description of the Prior Art

In the conventional image formation systems such as electrophotographic systems, electrostatic recording systems and others, it is usual that the development apparatus utilizes a black-colored developer. Recently, it has been broadly required to form an image using variously colored developers other than the black-colored developer, singly or in combination. For this purpose, a plurality of developing devices containing developers of different colors are provided, each of which is mountable into the image formation system to obtain an image of the desired image color. Or, the developing devices are selectively mounted in the same image formation system to form a superposed image in any desired color.

Where the developer is a developing device has been substantially fully consumed, the developing device must be resupplied with developer. In the prior art, the re-supply of the developer was carried out by inserting a cartridge-style developer container into the development device. If a plurality of containers containing differently colored developers are used, however, it is probable that the developing device will at some time be loaded with the wrong developer container, that is, the container having a different color developer, so that an image in an unwanted color will be formed. In addition, the original and re-supplied developers will be mixed with each other, which requires disassembling and cleaning the whole development system in order to use the same again in good order. The prior art developing systems have no means for overcoming such a problem.

SUMMARY OF THE INVENTION

It is an object of the present invention to overcome the above disadvantages in the prior art and to make it certain that a developer container of the right color containing the same colored developer as the original color will be mounted to a developing device.

Another object of the present invention is to provide a development device in which a developer container of the right color can positively and easily be mounted.

Still another object of the present invention is to provide a developer container which can reliably be mounted into the right developing device, that is, the one having the right color.

A further object of the present invention is to provide a developer container which can positively and easily attain the supply of a selected colored developer by inserting it into the developing device and then rotating the same in a predetermined direction.

A further object of the present invention is to provide a developer container including means for discriminating the color of developer which is contained therein.

Other objects and features of the present invention will be apparent from reading the following detailed description in conjunction with the accompanying drawings.

DESCRIPTION OF THE PREFERRED EMBODIMENTS

Figure 1:
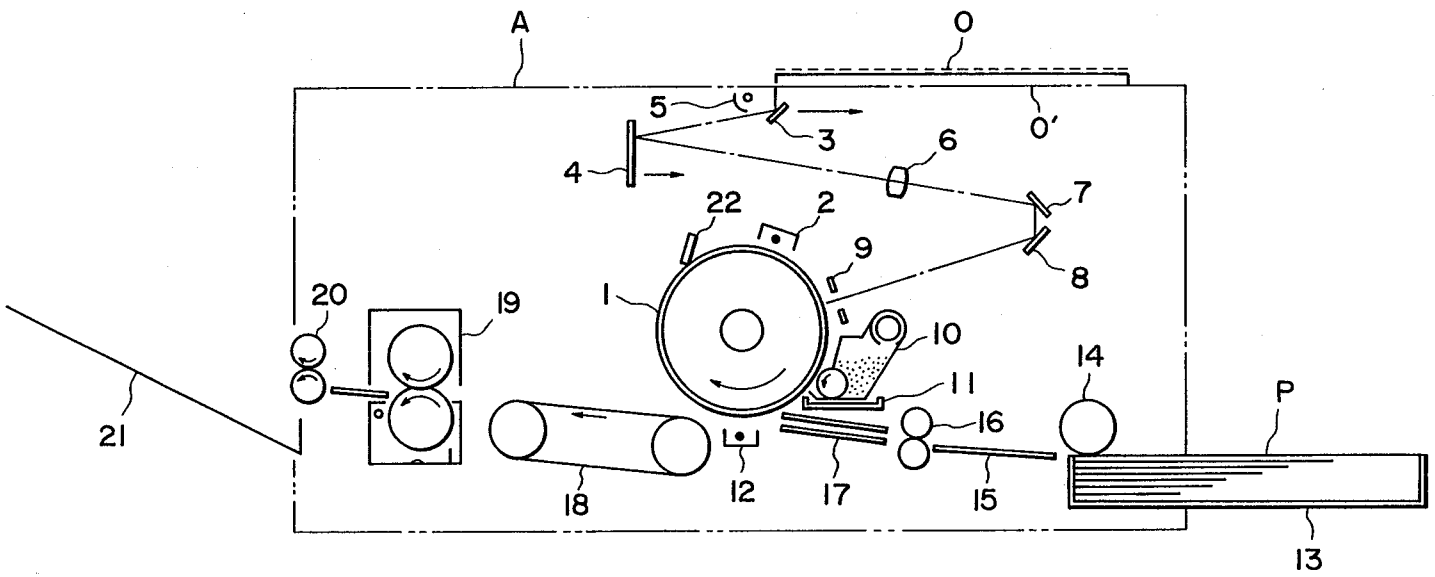
FIG. 1 is a diagrammatic view showing one example of electrophotographic systems.

FIG. 1 is a diagrammatic view showing an electrophotographic system usable as an image formation system to which the developing device according to the present invention can be applied.

In FIG. 1, the system comprises a photo-sensitive drum 1 having an electrophotographic type photosensitive member mounted thereon around the outer periphery and which can be rotated in the direction of the curved arrow. As the drum 1 is rotated, it is first uniformly charged by means of a corona discharger 2 and then exposed to the light image of an original to be copied O through a slit 9 to form an electrostatic latent image corresponding to the original 0 on the drum 1.

The original O is placed on a carriage of glass O' and scanned by scanning mirrors 3 and 4 which are moved in the direction of the arrow at a speed ratio of 1:½. At the same time, an illuminator 5 is moved integrally with the mirror 3 to illuminate the original. The original O scanned in this manner is imaged through a lens 6 with the imaging beam being reflected by stationary mirrors 7 and 8 and the incident on the drum 1 through said slit 9.

Said latent image is developed at a developing device 10 to form a developed image. The developing device 10 is detachably mounted in the system body A by sliding it along a guide rail 11. Thus, the developing device may be replaced by another new developing device containing a developer of the desired color. The developing device is described in more detail below.

The developed image is then transferred to a sheet of paper P under the action of a transfer charger 12. The paper P is from a supply cassette 13 from which paper is fed out by a feed roller 14 one sheet at a time. The paper is guided to timing rollers 16 along a guide plate 15. Timed with the scanning of the original, the paper P is moved to a transfer station where the above transfer step is effected, by means of the timing rollers 16 along guide plates 17. After the transfer step, the paper P is separated from the drum 1 and moved to a fixing device 19 by means of a conveyor belt 18. As the paper P is being moved through the nip between fixing rollers, the developer on the paper P is dissolved under heat so that the image will be fixed to the paper P. After the fixing step, the paper P is discharged into a paper receiving tray 21 by discharge rollers 20 which are rotated in the direction of the arrow to move the paper outwardly through the nip between the discharge rollers 20.

The developer remaining on the drum 1 after the transfer step is removed by a cleaner 22. Then, the drum 1 may be used again to execute the same image formation process.

The portion of the developing device into which a developer container is to be inserted will be described with reference to FIGS. 2A and 2B.

Figure 2A:
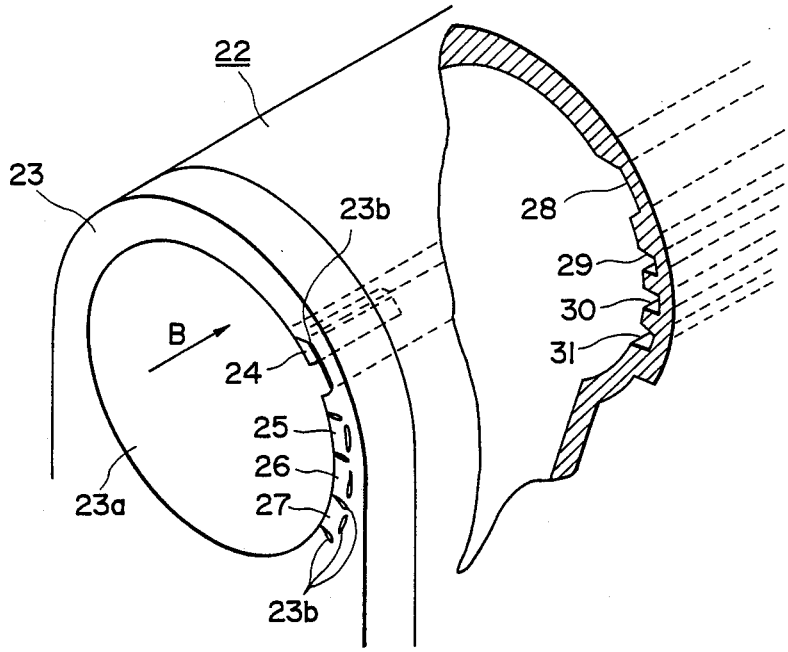
FIGS. 2A and 2B are perspective views showing the portion of a developing device according to the present invention into which a developer cartridge is inserted.

Referring to FIG. 2A, there is shown herein a developer storage receptacle 22 (hereinafter called simply "developer receptacle") which is adapted to receive a developer cartridge used as the developer container. The developer receptacle 22 supports a covering 23 having an opening **23*a* formed therein through which the developer cartridge is inserted into the developer receptacle 22. As shown, the covering 23 includes a notch 23*b* formed therein at the edge of the opening 23*a* and removable pawls 24, 25, 26 and 27 formed around the peripheral edge of the opening 23*a*. Each of these pawls is matched to a respective one of developers having different colors which are to be used in the system. For example, the pawl 24 corresponds to black; the pawl 25 to sepia; the pawl 26 to blue; and the pawl 27** to magenta.

The development receptacle 22 includes a plurality of longitudinal grooves 28, 29, 30 and 31 formed therein at the inner wall thereof, which grooves correspond to the respective removable pawls. Each of the pawls is located at the entrance of the corresponding groove. Each of the grooves serves as a guide which engages a protrusion on the corresponding developer cartridge and guides the developer cartridge against rotation when the cartridge is inserted into the development receptacle 22.

The grooves 29, 30 and 31 need not be separated. In other words, the partition walls between the grooves 29 and 30 or between the grooves 30 and 31 may be omitted.

Figure 2B:
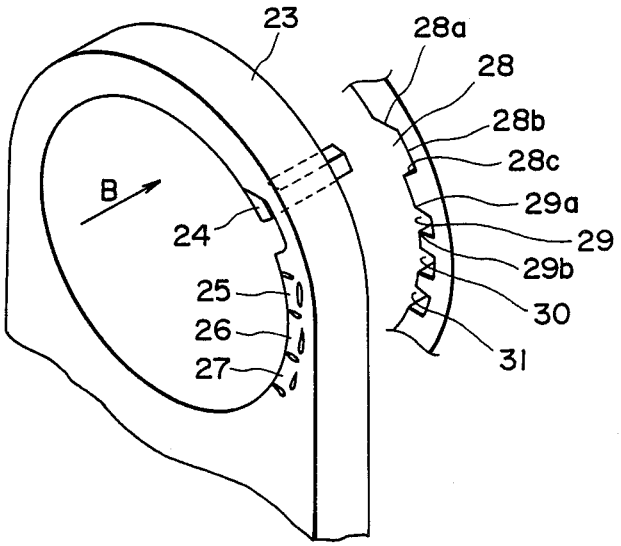

FIG. 2B is a pespective view showing the cover 23 removed from the developer receptacle 22 and part of the grooves formed in the developer receptacle 22.

As seen from FIG. 2B, the pawl 24 is elongated longitudinally of the developer receptacle and so disposed that the pawl 24 cannot easily be removed by a force applied in a direction of arrow B (the direction of the cartridge insertion into the development receptacle) since the pawl 24 will contact either of the sides **28*a* or 28*b* of the groove 28 in the developer receptacle when a force is applied to the pawl 24 in the direction of arrow B. Each of the pawls 25, 26 and 27 on the covering 23 is of a width slightly larger than that of the corresponding groove 29, 30 or 31 on the developer receptacle. Therefore, if a force is applied to the pawl 25 in the direction of arrow B, it will contact the sides 29*a* and 29*b* of the groove 29 at the entrance thereof. Thus, the pawl 25 will not easily be removed by the force produced when the cartridge is to be inserted, as with pawl 24. This is also true of pawls 26 and 27**.

The removable pawls 24–27 may be separated from the covering 23 by pulling them in the direction opposite to the direction in which the cartridge is inserted.

The number and configurations of the pawls and grooves may suitably be selected as required.

Figure 3:
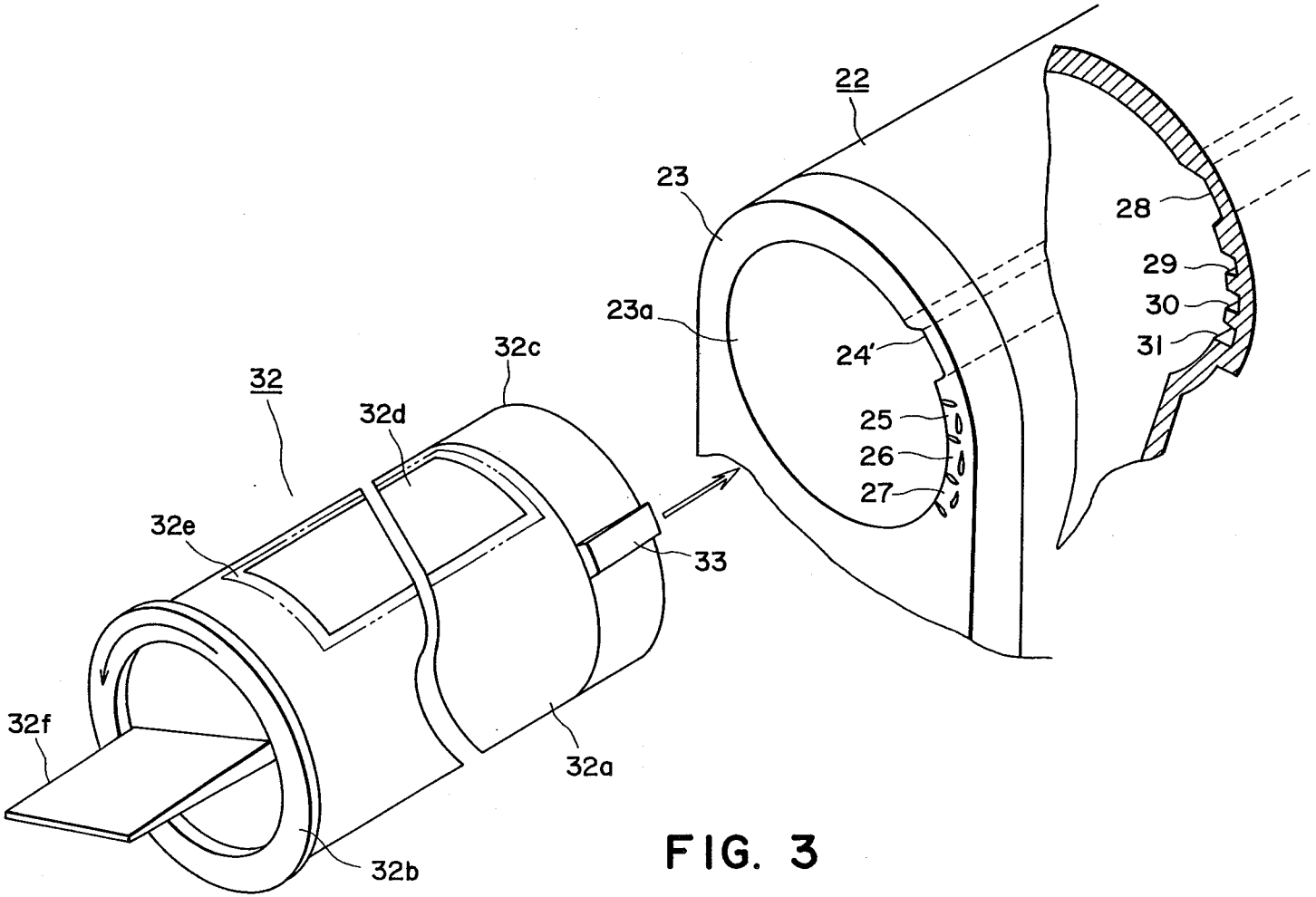
FIGS. 3 and 4 illustrate the engagement of the developer cartridge with the developing device.

FIG. 3 shows a state in which the covering 23 is mounted on the development receptacle after the pawl 24 has been removed from the covering 23. FIG. 3 illustrates a developer cartridge 32 having a cylindrical elongated containing portion **32*a* made of paper, plastics or other materials and containing a black-colored developer therein. The cylindrical container 32*a* includes flanges 32*b* and 32*c* of plastics material mounted thereon at the opposite ends. The flange 3*b* is of an outer diameter larger than that of the cylindrical container 32*a* and includes a knob 32*f* formed therein. The flange 32*c* includes a protrusion 33 formed thereon at the outer periphery thereof and which has its relatively large width. The cylindrical container portion 32*a* includes a longitudinally extending opening 32*d* formed therein such that it has a sufficient length to easily discharge the contained developer into a given developer supply port in the development device. The opening 32*d* is sealed by a sealing member 32*e*. Further, the flange 32*c*** receives a cap (not shown) after the developer has been put in the cylindrical container portion.

When the developer cartridge 32 is inserted into the developer receptacle 22, the protrusion 33 on the flange **32*c* engages the corresponding groove 28 on the developer receptacle 22. This is made possible by the fact that the pawl 24 is removed from the covering 23 to form a passage 24' through which the cartridge 32 containing the black-colored developer can be inserted into the development receptacle 22**.

Said protrusion 33 is used as a reference for positioning the developer cartridge 32 within the developer device when the developer cartridge 32 is inserted and rotated in a predetermined direction.

It is preferred that said opening **32*d* and an opening 34*d* which will be described hereinafter are disposed relative to said protrusion 33 and a protrusion 35** which will also be described hereinafter substantially at the same positional relationship with respect to the predetermined direction of rotation of the cartridge so that each of the openings in the cartridge will always be aligned with the given developer supply port in the developing device if any developer cartridge is used in the development system.

Figure 4:
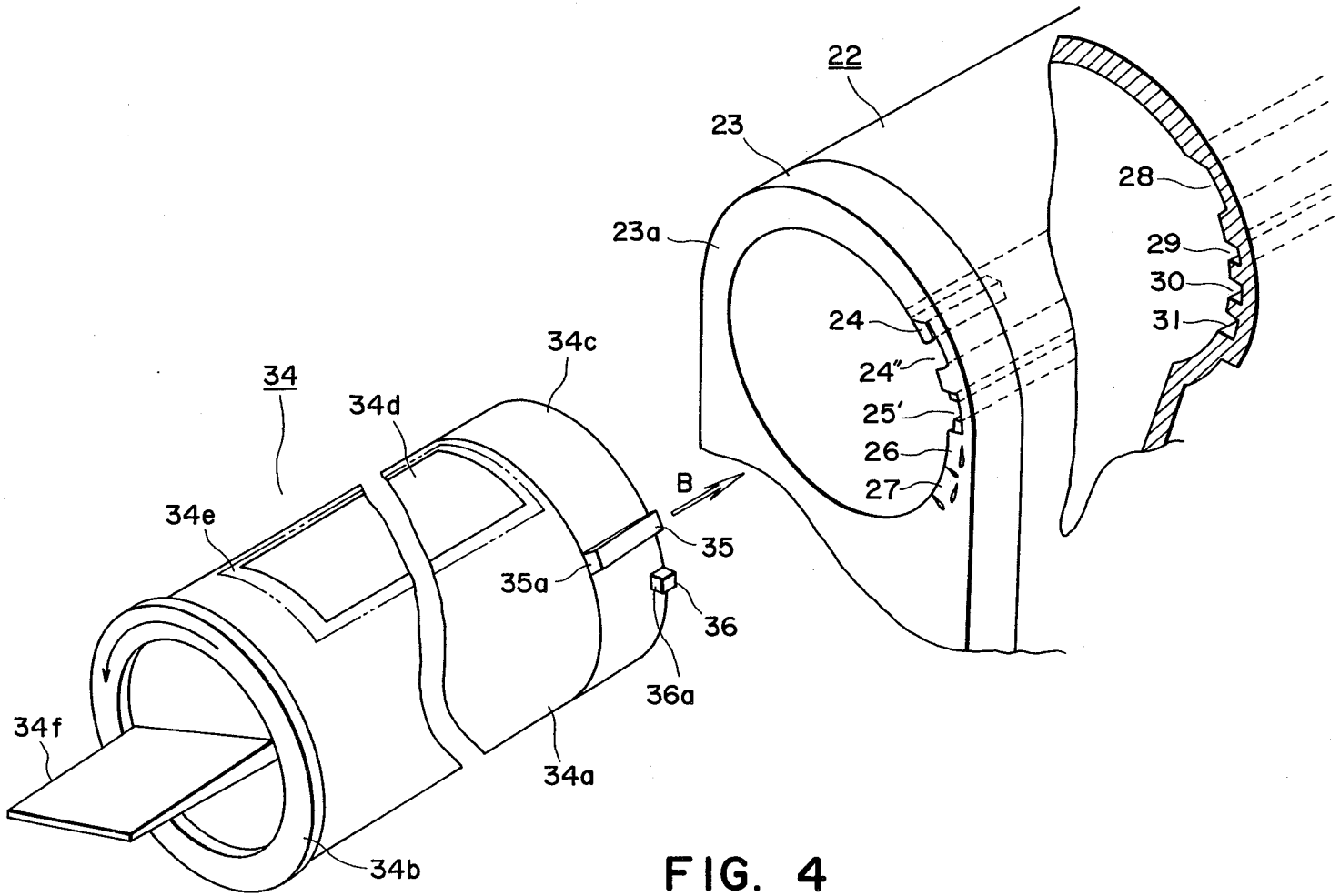

FIG. 4 is a perspective view showing the pawl 25 being removed from the covering 23 without removing the pawl 24. The developer cartridge 34 is one that contains the developer of sepia color. This cartridge 34 includes two protrusions 35 and 36 formed on the rearward end flange **34*c* and spaced away from each other around the output periphery of the cartridge 34. The protrusion 35 is used as a reference protrusion for positioning the developer cartridge 34 within the development device 22 when the cartride 34 is inserted into the developing device 22 and then rotated in the predetermined direction. The other protrusion 36 is used to discriminate the color of the developer contained in the selected developer cartridge 34. When the developer cartridge 34 is inserted into the developing device 22 with the opening 34*d* being faced up, the positioning and color-discriminating protrusions 35 and 36 are adapted to align with the recesses 24'' and 25'** of the covering 23, respectively. These protrusions 35 and 36 also are adapted to align with the grooves 28 and 29 of the development device, respectively. The longitudinally extending pawl 24 facilitates the guidance of the protrusion 35 along the recess 24" and the groove 28. The geometric arrangement of two protrusions 35 and 36 on the developer cartridge 34 is such that the protrusion 36 is changed in position relative to the longer reference protrusion 35 to engage in the groove 30 of the development receptacle for blue color and to engage in the groove 31 for magenta color. In this case, the pawl 26 or 27 will suitably be removed from the covering 23, corresponding to the developer cartridge to be used. In other words, the developer to be used will be determined by removing a pawl from the covering 23 in accordance with the desired color.

The engagement of the developer cartridge shown in FIG. 3 or 4 with the developing device will be further considered. Even if one tries to insert the cartridge 32 of FIG. 3 into the developing device as shown in FIG. 4, this cartridge 32 cannot be inserted thereinto because the positioning and color-discriminating protrusion 33 having its width larger than that of the recess 24" engages the pawl 24. On the contrary, even if it is attempted to insert the cartridge 34 of FIG. 4 into the developing device shown in FIG. 3, this cartridge 34 cannot be inserted into that developing device since the protrusion 36 is engaged by the pawl 25. By the fact that each of the pawls may be used as means for preventing the insertion of the developer cartridge into the development device by causing the pawl to engage the corresponding protrusion on the developer cartridge, a developer cartridge will not be accidentally inserted into the wrong developing device in place of a different developer cartridge. Although a new developing device can be applied to any one of many developer cartridges, it can be applied only to a particular developer cartridge after any one of the aforementioned pawls has been removed from the developing device.

Thus, the combination of the selectively removed pawl of the developing device and the protrusion or protrusions provided on the developer cartridge enables only one kind of the cartridges to be inserted into the developing device.

If the number of the pawls in the covering 23 is increased with the corresponding grooves of the developer receptacle being increased in number, more kinds of developer cartridges containing different colors may be utilized.

Figure 5:
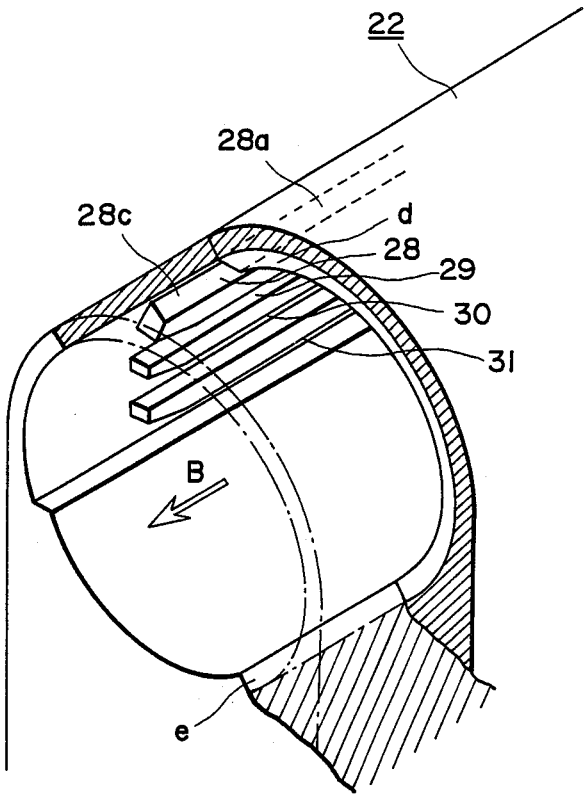
FIG. 5 is a partially broken out view showing the developer cartridge inserting portion of the developing device as backwardly viewed in FIGS. 2A and 2B.

FIG. 5 is a partially broken-away view of the cartridge receiving portion of the development receptacle 22 as viewed backwardly of the developing device. The groove 28 shown in FIG. 2 has its terminal end at which the opposite sides 28*a* and 28*c* of the groove 28 are positioned at different levels in the longitudinal direction of the development receptacle, that is, the direction B in which the cartridge is inserted into the developer receptacle, as shown in FIG. 5. Also, the side 28*c* is of greater length than that of the other side 28*a* in the direction B. The opposite sides of each of the grooves 29, 30 and 31 is substantially of the same length as that of the side 28*c* of the groove 28. This is because after the cartridge has been inserted into the development device, the cartridge can be rotated to face the opening thereof downwardly so that the developer will be supplied from that cartridge to the developer receptacle. If the cartridge cannot be prevented from rotating by any color discriminating protrusion as shown by 36 which would be engaged by the above sides, it is not necessarily required that the length of each of the grooves 29, 30 and 31 is equal to that of the side 28*a* of the groove 28.

The side 28*c* of the groove 28 serves as a stopper surface adapted to engage the protrusion 35 on the cartridge such that the cartridge cannot be rotated rightwardly with respect to the direction B, that is, counterclockwise as viewed in FIG. 5. A surface d serves as means for preventing the cartridge from being drawn out by engaging the end face 35*a* of the protrusion 35 when the cartridge is rotated in predetermined direction as described later. A surface e serves as a rotation limiting section or stopper surface for limiting the rotation of the cartridge up to about 180 degrees so as to positively align the opening 34*d* of the cartridge with the developer supply port (not shown) of the developer receptacle when the cartridge is rotated after it has been inserted into the developing device.

The cartridge 34 can detachably be mounted in the developing device as follows: The sealing member 34*e* is gripped with the opening 34*d* of the cartridge 34 faced up. Subsequently, by manually using the knob 34*f* of the flange 34*b* on the cartridge 34, it is inserted, while removing the sealing member by relatively pulling it, into the developer receptacle 22 with the opening 34*d* thereof faced upwardly while respectively aligning the protrusions 35 and 36 on the cartridge 34 with the recesses 24" and 25' of the covering 23 and thus the grooves 28 and 29 of the developmental receptacle 22 as shown in FIG. 4. The cartridge 34 is fully moved inwardly until the flange 34*b* engages the cover 23, which, therefore, serves as a stopper for the cartridge in the direction B.

Figure 6:
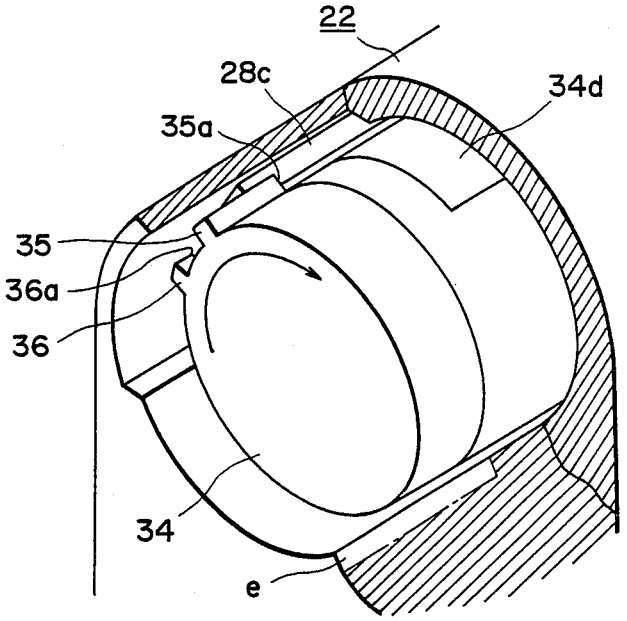
FIGS. 6 and 7 are perspective views showing the insertion of the developer cartridge into the developing device as viewed backwardly of the developer.

FIG. 6 shows such a state as viewed from the rearward end of the cartridge. As described above, the side 28*c* of the groove 28 is longer than the side 28*a* of the same. The length of the side 28*c* is such that the terminal end of the side 28*c* will be substantially at the midway between the end face 35*a* of the longer protrusion 35 and the end face 36*a* of the shorter protrusion 36 on the cartridge 34. This is because the cartridge can be rotated only in the direction arrow to supply the developer therefrom to the developer receptacle after the cartridge has been inserted thereinto. The rearward end of the development receptacle has the inner diameter permitting the above protrusions to move in the rotational direction as shown in FIG. 6.

Figure 7:
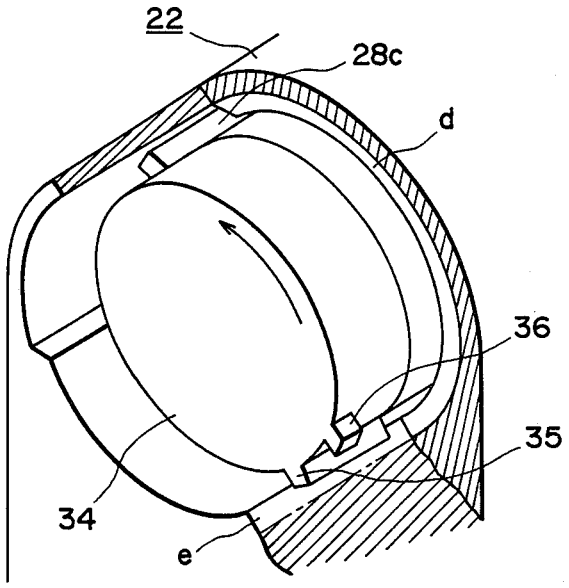

After the cartridge 34 has been inserted into the developing device and if the cartridge 34 is rotated counterclockwise (clockwise as viewed in Figure 6) with respect to the direction B in which the cartridge is inserted into the developer receptacle, the protrusion 35 will be engaged by the stopper surface e to stop the rotation of the cartridge 34 through the angle of about 180 degrees. At this time, the opening 34*d* of the cartridge 34 will be faced downwardly to align with the developer supply port (not shown) of the developer receptacle so that the developer will be supplied to the developer receptacle through the opening 34*d* of the cartridge 34 (see FIG. 7).

The cartridge 34 can be removed from the developing device by rotating the cartridge 34 in the opposite direction (counterclockwise relative to the plane of FIG. 7) until the protrusion 35 of the cartridge 34 engages the side face 28*c* of the groove 28 (see FIG. 6). The cartridge 34 then may easily be drawn out of the developing device. At this time, the opening 34*d* of the cartridge 34 is faced upwardly so that any remaining developer will not leak out of the cartridge. While the cartridge is inserted into or removed from the developing device, the shorter protrusion 36 of the cartridge 34 will not be obstructed so that nothing will interfere with the rotation of the cartridge. This is true of the other protrusions on the cartridges for blue, magenta and other colors. When the cartridge 32 of FIG. 3 containing the black-colored developer is mounted in the corresponding developer receptacle, two the limitation of rotation on the cartridge can similarly be effected by the protrusion 33 thereon engaging the side 28*c* of the groove 28 and the stopper surface 3.

Figure 8:
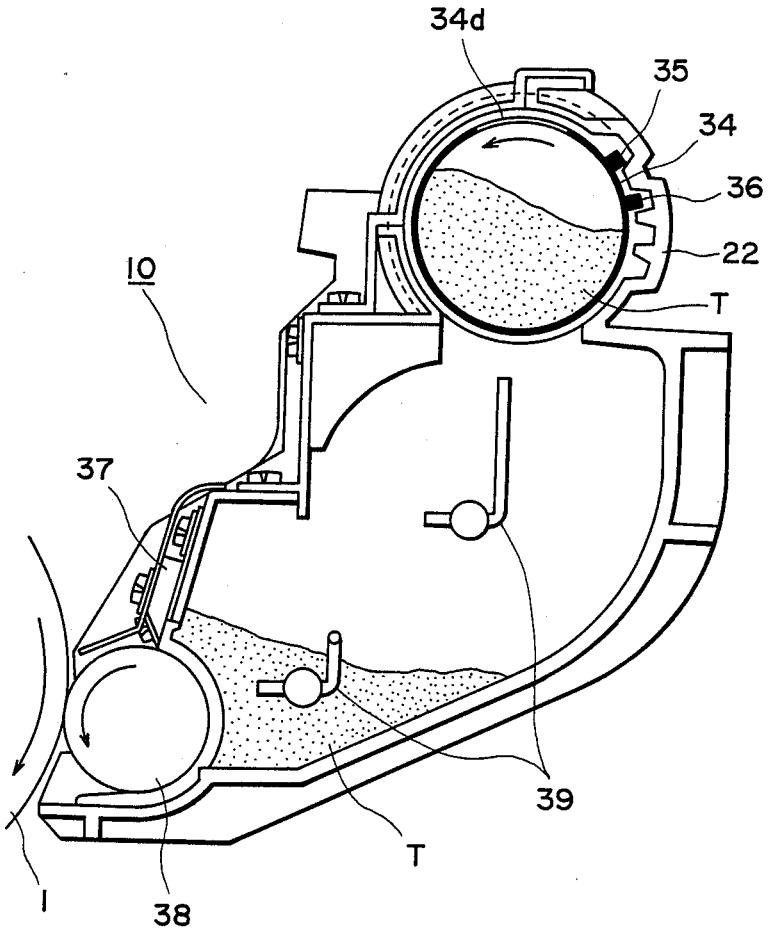
FIGS. 8 and 9 are cross-sectional views of the entire developing device.
Figure 9:
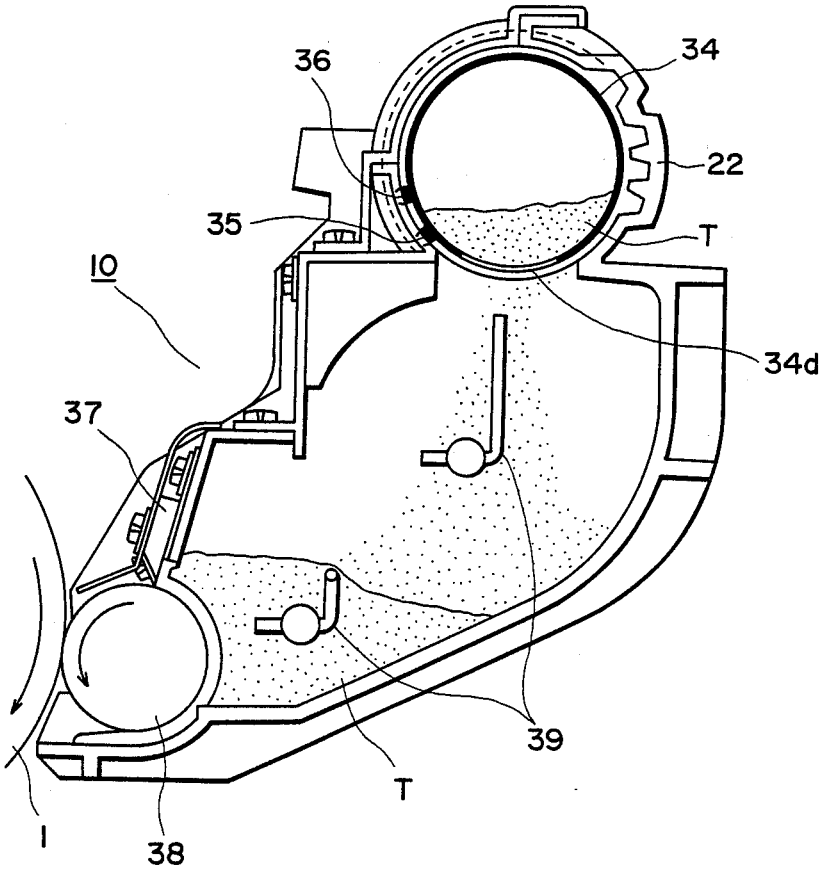

FIGS. 8 and 9 are cross-sectional views of the entire developing device, showing the engagement of the developer cartridge with the developer receptacle which has been described with reference to FIGS. 4 through 7. FIGS. 8 and 9 depict the photosensitive drum or latent image bearing member 1, a blade 37 for controlling the thickness of the developer layer, a development sleeve or developer carrying means 38 for supplying the developer T onto the photosensitive drum 1 to develop the latent image, the sleeve including a magnetic member located therein, and an agitator rod 39 for agitating the developer T.

FIG. 8 shows the developer cartridge 34 inserted into the developer receptacle 22. If the cartridge 34 is rotated from such a condition as shown in FIG. 8 through about 180 degrees in the direction of arrow, the opening 34*d* of the cartridge 34 will be faced downwardly to supply to the developer receptacle 22 therethrough as shown in FIG. 9. The supplied developer T is then agitated to mix in the developer previously supplied in the developer receptacle by means of the agitating rod 39. The developer carrying means 38 supports and moves the developer T in the direction of arrow. During this, the layer of the developer T is controlled in thickness by the blade 37. Thereafter, the developer T is used to develop the latent image on the photosensitive drum 1.

Figure 10:
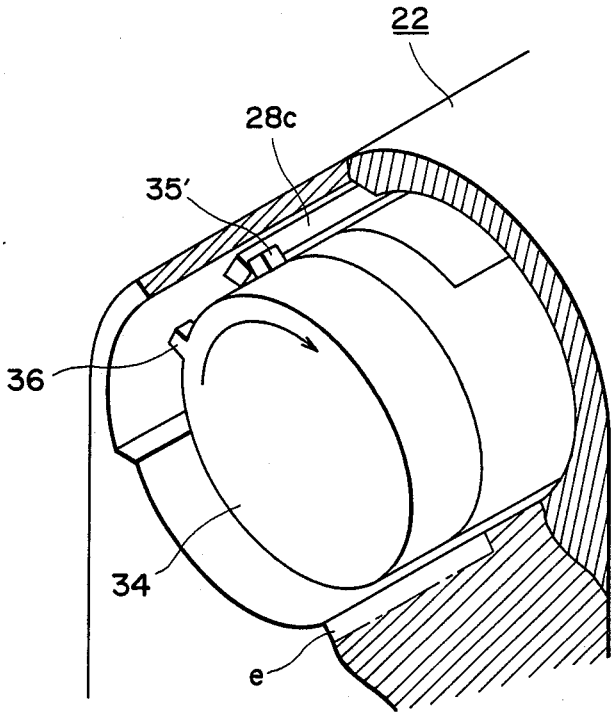
FIG. 10 is a view showing protrusions of the developer cartridge.

Although the previous embodiments have been described as to the positioning protrusion on each of the cartridges which has its length larger than that of the other protrusion on the same cartridge in the direction of cartridge insertion, a protrusion 35' having the same size as that of the protrusion 36 may be located on the cartridge at a position different from that of the protrusion 36 such that when the cartridge is fully inserted into the developer receptacle, at least the protrusion 35' will be engaged by the side face 28*c* of the groove 28, as shown in FIG. 10. This provides the insertion and removal of the cartridge similar to those of the previously described cartridges.

If the cartridge has been completely inserted into the developing device, that is, when the cartridge has been inserted into the developing device until the forward flange 34*b* thereof is engaged by the covering 23, it is only required that at least part of the positioning protrusion is placed at such a position that it is engaged by the side 28*c* of the groove 28 and that this positioning protrusion is spaced away from the surface d which is used to prevent the cartridge from being drawn out of the developer receptacle. That is, it is only required that both the positioning and color-discriminating protrusions are located at different positions from each other with respect to the direction of cartridge insertion such that the color-discriminating protrusion will not be obstructed.

Since the positioning protrusion is located on the cartridge forwardly of the color-discriminating protrusion with respect to the predetermined direction, the cartridge can always be limited in rotation at the same fixed or positioning protrusion. Thus, it is possible that the opening formed in the cartridge is easily and positively aligned with the developer supply port of the developing receptacle.

Figure 11:
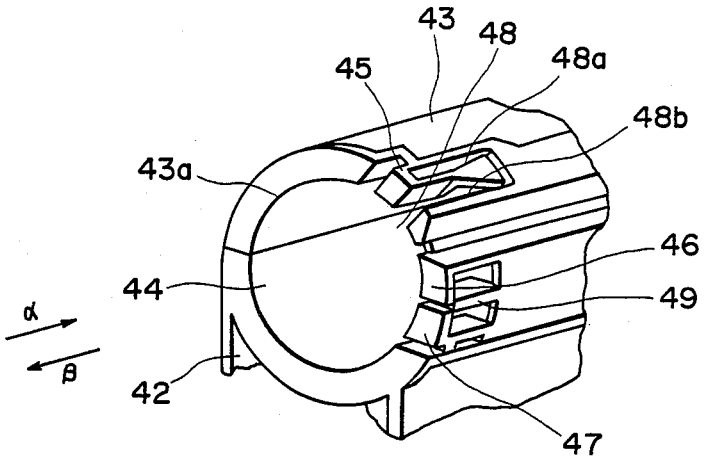
FIG. 11 is a perspective view of another embodiment of the present invention, showing the portion of the developing device into which a developer cartridge is inserted.

FIG. 11 is a perspective view of the cartridge insertion portion of a developing device which is another embodiment of the present invention. Referring to FIG. 11, a developer receptacle 42 and a cap 43 mounted thereon, which define a developer storage receptacle having an opening 44 through which a cartridge is to be inserted into the receptacle. The cap 43 includes an opening 43*a* formed therein which has a plurality of removable stoppers 45, 46 and 47 formed therein along the circumference of the cap and corresponding to the respective developers different in color from one another. The stopper 45 extends longitudinally of the developer receptacle as shown in FIG. 11. If a force is applied to the stopper 45 in the direction of arrow $\alpha$ or $\beta$, the stopper 45 will be flexed into engagement with the side face 48*a* or 48*b* of a recess 48 such that the stopper 45 will not easily be damaged by the above force. The cartridge will be inserted into the developer receptacle in the direction $\alpha$ and drawn out of the same receptacle in the direction $\beta$. If a force is applied to the stopper 46 or 47 in the direction $\alpha$, it will be flexed into engagement with a dowel 49 on the cap 43 such that the stopper cannot be damaged easily by this force. As in the previous embodiments, a plurality of grooves extend along the length of the cap 43 and are adapted to receive the similar protrusion of the corresponding cartridge when the corresponding stopper is removed from the cap. In addition, means for limiting the rotation of the cartridge and the procedure of inserting and drawing the cartridge are similar to those of the previously described embodiments.

Figure 12:
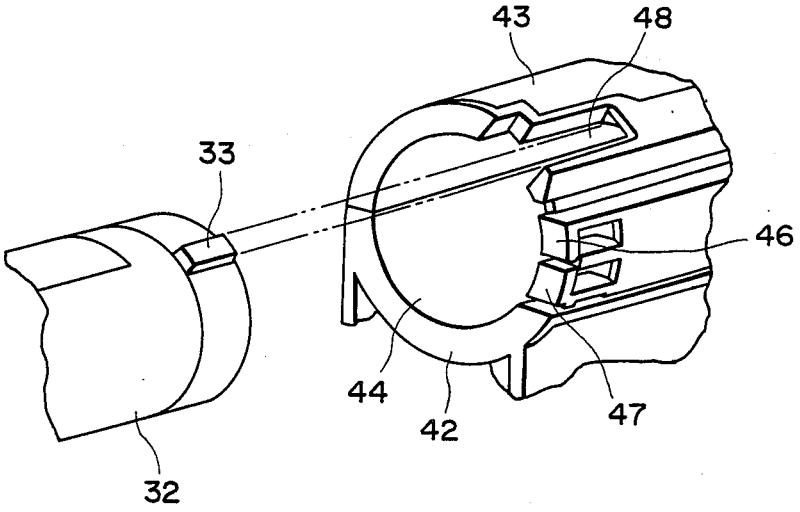
FIGS. 12, 13 and 14 illustrate the engagement of the developer cartridge shown in FIG. 11 with the developing device.
Figure 13:
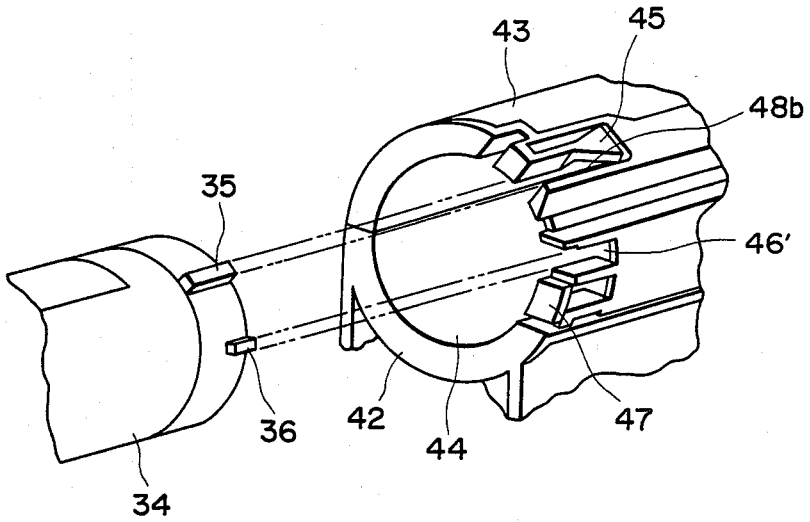
Figure 14:
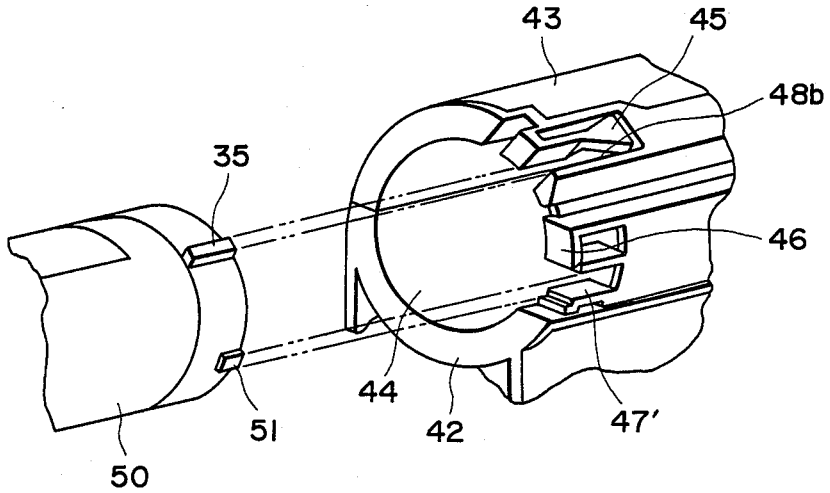

FIGS. 12, 13 and 14 shows the relationship between the cartridge and the developing device with respect to different colored developers.

FIGS. 12 depicts such a case that the stopper 45 is removed from the cap 43. The cartridge 32 containing, for example, black-colored developer can be inserted into the developing device with the wider protrusion 33 thereon passing through a recess 48 which has been formed by removing the stopper 45.

FIG. 13 shows a case in which the stopper 46 is removed from the cap 43. In this case, a cartridge 34 to be mounted contains, for example, sepia-colored developer and includes a longer protrusion 35 extending longitudinally on the cartridge 34 and a shorter protrusion 36 spaced away from the longer protrusion 35 along the periphery of the cartridge 34. Thus, the cartridge 34 can be inserted into the developing device by passing the protrusion 35 through a recess defined by the stopper 45 and the side face 48*b* of the recess 48 and by passing the other protrusion 36 through a recess 46' formed by removing the stopper 46.

In FIG. 14, the stopper 47 is removed from the cap 43 to form a recess 47'. A cartridge 50 containing, for example, magenta-colored developer includes the same protrusion 35 as in FIG. 13 and a shorter protrusion 51 spaced away from the longer protrusion 35 along the periphery of the cap by a distance larger than that between two protrusions 35 and 36 as in FIG. 13. The cartridge 50 can be inserted into the developing device by passing the longer protrusion 35 through a recess defined by the stopper 45 and the side face **48*b* of the recess 48 and by passing the protrusion 51 through the recess 47'**.

In this manner, the cartridge 32 can only be inserted into the developing device shown in FIG. 12; the cartridge 34 can only be inserted into the developing device shown in FIG. 13; and the cartridge 50 can only be inserted into the developing device shown in FIG. 14. Therefore, the wrong cartridge will not be inserted into a developing device.

Figure 15A:
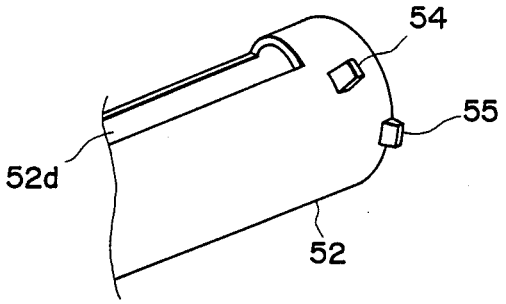
FIGS. 15A, 15B and 15C illustrate the engagement of the developer cartridge with the developing device in still another embodiment of the present invention.
Figure 15B:
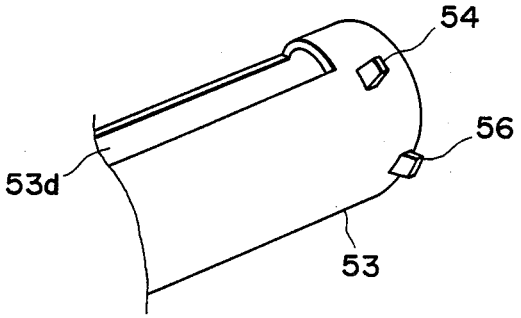
Figure 15C:
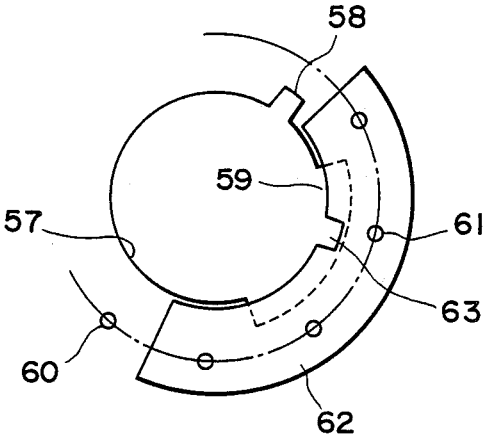

FIGS. 15A, 15B and 15C show still another embodiment of the present invention in which two developer cartridges 52 and 53 containing different colored developers are used. Each of the cartridges 52 and 53 includes two protrusions formed therein on the outer periphery and spaced away from each other longitudinally and circumferentially of the cartridge. As in the previously described embodiments, the protrusions prevent the corresponding cartridge from rotating in the direction opposite to the predetermined direction after the cartridge has been fully inserted into the development device. More particularly, the protrusion 54 of the cartridge 52 serves as positioning means while the protrusion 55 thereof serves as color-discriminating means spaced away from the protrusion 54 along the periphery of the cartridge by a suitable distance. In the cartridge 53, the protrusion 56 thereof serves as color-discriminating means spaced away from the positioning protrusion 54 along the periphery of the cartridge by a distance different from that between the protrusion 54 and 55 in the cartridge 52.

As shown in FIG. 15C, a developing device adapted to receive the above cartridges 52 and 53 includes a groove 58 for receiving the protrusion 54 which is formed in the developing device at its inner edge 57, this groove 58 corresponding to the groove 28 in the developer receptacle described above. The developing device also includes a groove 59 formed therein at its inner edge 57 and extending along the inner periphery of the developing device through a larger distance, this groove 59 corresponding to the grooves 29, 30 and 31 in the developer receptacle described previously. The developing device further includes a threaded aperture 60 formed therein at the end face. A sector member 62 is mounted on the developing device at its end face and includes a plane aperture 61 aligned with the threaded aperture 60 of the developing device and an inner edge registered substantially with the inner edge 57 of the developing device. The sector member 62 includes a recess 63 formed therein at its inner edge, which recess 63 permits the color-discriminating protrusions 55 and 56 of the cartridges 52 and 53 to pass therethrough. If it is desired to insert each of the cartridges into the corresponding developing device to supply developer thereto, the sector member 62 is re-positioned relative to the developing device such that the distance between the recesses 58 and 63 will be match that between the protrusions of the corresponding cartridge. Thereafter, the sector member 62 is fastened to the development device by screws or any other suitable means. While a sealing element (not shown) closing the opening **52*d* or 53*d* in each of the cartridges is being removed, that cartridge is inserted into the developing device with the opening thereof faced upwardly by passing the protrusions on the cartridge through the groove 58 and the recess 63 of the sector member 62, respectivelly. Thereafter, the cartridge is rotated through about 180 degrees leftwardly as viewed in FIG. 15C** to align the opening of the cartridge with the developer supply port of the developing device.

In this manner, the cartridge 52 can easily be inserted into the corresponding developing device by positioning and fastening the sector member 62 relative to the developing device so that the protrusions 54 and 55 of the cartridge 52 can be permitted to pass through the groove and recess 58, 63 on the developing device. If it is attempted to insert the other cartridge 53 into the same cartridge, however, this is impossible since the distance between the protrusions 54 and 56 is different from that between the groove 58 and the recess 63 of the sector member 62 in the developing device corresponding to the above cartridge 52.

Thus, a wrong cartridge cannot be inserted into a developing device.

In the embodiment described just above, the portion of the developing device for receiving the cartridge may be constructed similarly to the previous embodiments, for example, the embodiment shown in FIG. 5.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus in which a developer container can detachably be mounted, said container including reference means for positioning said developer container within said development apparatus and color-discriminating means used to represent the color of the developer contained in the container, said developer container being adapted to be set within said developing apparatus by rotating said container after it has been inserted into the developing apparatus, the developing apparatus comprising:

a developer receptacle for receiving said developer container and storing the developer supplied from said developer container to said receptacle;

said receptacle including a first passage means for receiving said reference means of said developer container and permitting said reference means to pass therehrough, a second passage means for receiving said color-discriminating means of said developer container to permit it to pass therethrough, rotation passage means for permitting said reference means and color-discriminating means on the developer container to pass therealong when said developer container is rotated in a predetermined direction, means for limiting the rotation of said developer container by engaging the reference means on the developer container when said developer container is rotated in said predetermined direction, said first passage means being located downstream of said second passage means in said predetermined rotational direction; and developer carrying means for supplying the developer from said developer receptacle toward a latent image bearing member to develop the latent image.

2. A developing apparatus as defined in claim 1, wherein said developer container receptacle includes an opening for receiving said developer container.

3. A developing apparatus as defined in claim 2, wherein said first passage means has a length smaller than that of said second passage means.

4. A developing apparatus as defined in claim 3, wherein said first and second passage means include grooves extending along the length of said developer storage receptacle.

5. A developing apparatus as defined in claim 4, wherein there are a plurality of said second passage means each of which corresponds to respective ones of said color-discriminating means corresponding to different colors of developers.

6. A developing apparatus as defined in any one of claims 1 through 5, wherein said rotation limiting means includes a stopper surface formed in said developer receptacle to permit the rotation of said developer container by such an amount that the developer can be supplied from said developer container to said developer receptacle when said developer container has been rotated in said predetermined direction.

7. A developing apparatus as defined in any one of claims 1 through 5, wherein said developer receptacle includes a cap member formed separately from that portion of said developer receptacle which is adapted to store the developer and wherein the passage section of said developer storage receptacle is formed in said cap member.

8. A developing apparatus as defined in claim 7, wherein, said developer receptacle includes an opening for receiving said developer container, said opening being defined by that portion of said developer receptacle which is adapted to store the developer and said cap member.

9. A developing apparatus as defined in any one of claims 1 through 5, wherein said developer receptacle includes a surface along said rotation passage for the reference means of said developer container, for preventing said developer container from being drawn out of said developer receptacle.

10. A developing apparatus as defined in any one of claims 1 through 5, wherein said developer carrying means is in the form of a development sleeve including a magnetic member therein.

11. A developing container which can be set within a developing device by inserting said container into said developing device and then rotating said container in a predetermined direction, comprising:

a housing for containing a developer;

a developer supply port for supplying said developer to said developing device;

reference means for positioning said container within said developing device, said reference means being adapted to engage a rotation limiting section on said developing device when said container is inserted into said developing device and then rotated; and color-discriminating means corresponding to the color the the developer contained therein, said color-discriminating means being adapted to pass through a passage section formed in said developing device matching the color of a selected developer when said developer container is inserted into said developing device; said reference means being located downstream of said color-discriminating means in said predetermined rotational direction.

12. A developer container as defined in claim 11, wherein at least part of said reference means and said color-discriminating means are disposed at different positions in the direction of insertion of said developer container into the developing device such that when said developer container is inserted into said developing device, said reference means is out of a passage for permitting the passage of said reference means and the terminal end of the passage section of said color-discriminating means reaches a position between said reference means and said color-discriminating means.

13. A developer container as defined in claim 11, wherein said developer supply port is located downstream of said reference means in said predetermined direction of rotation and wherein the positional relationship between said developer supply port and said reference means in said predetermined direction of rotation is substantially constant independently of the color of the developer contained in said developer container.

14. A developer containing vessel as defined in claim 11, wherein said color-disciminating means is disposed at a position spaced away from said reference means in said predetermined direction of rotation by a distance corresponding to the color of the development contained in said developer container.

15. A developer container as defined in any one of claims 11, 12, 13 and 14, wherein said reference means and color-discriminating means include protrusions formed on said housing of said developer containing at its rearward end.

16. A developer container as defined in claim 11, wherein said developer container further includes knob means formed in said housing, said knob means serving as a stopper which engages the container receiving portion of said developing device to prevent said developer container from moving inwardly in said developing device beyond a predetermined amount when said developer containing is inserted into said developing device.

17. A developer container as defined in claim 11, wherein said developer supply port is formed on the outer periphery of said housing to extend longitudinally.

* * * * *

UNITED STATES PATENT AND TRADEMARK OFFICE

CERTIFICATE OF CORRECTION

PATENT NO. : 4,740,808

DATED : April 26, 1988

INVENTOR(S) : TOSHIROU KASAMURA, ET AL.

It is certified that error appears in the above-identified patent and that said Letters Patent is hereby corrected as shown below:

AT [30] IN FOREIGN APPLICATION PRIORITY DATA

"Jan. 8, 1983 [JP] Japan ..... 58-1570" should be inserted at the end.

COLUMN 2

Line 39, "photo-sensitive" should read --photosensitive--.

COLUMN 4

Line 16, "flange 3b" should read --flange 32b--.

COLUMN 6

Line 42, "direction arrow" should read --direction of the arrow--.

COLUMN 7

Line 9, "two" should be deleted.
Line 12, "surface 3." should read --surface e.--.

COLUMN 8

Line 43, "FIGS. 12" should read --FIG. 12--.

COLUMN 9

Line 58, "be" should be deleted.
Line 67, "respectivelly." should read --respectively.--.

UNITED STATES PATENT AND TRADEMARK OFFICE

CERTIFICATE OF CORRECTION

PATENT NO. : 4,740,808

DATED : April 26, 1988

INVENTOR(S) : TOSHIROU KASAMURA, ET AL.

It is certified that error appears in the above-identified patent and that said Letters Patent is hereby corrected as shown below:

COLUMN 10

Line 9, "recess 58, 63" should read --recesses 58, 63--.
Line 11, "same cartridge," should read --same developing device,--.
Line 45, "therehrough," should read --therethrough,--.

COLUMN 11

Line 26, "wherein," should read --wherein--.

COLUMN 12

Line 2, "the the" should read --of the--.
Line 33, "development" should read --developer--.
Line 38, "containing" should read --container--.
Line 47, "containing" should read --container--.

Signed and Sealed this

Eighteenth Day of July, 1989

*Attest:*

DONALD J. QUIGG

*Attesting Officer*

*Commissioner of Patents and Trademarks*